US008141982B2

(12) United States Patent
Nakano et al.

(10) Patent No.: US 8,141,982 B2
(45) Date of Patent: Mar. 27, 2012

(54) COLOR IMAGING APPARATUS HAVING YELLOW NOZZLE ARRAY AND MAGENTA NOZZLE ARRAY ON SAME HEAD AND SHIFTED RELATIVE TO EACH OTHER BY A HALF-PITCH

(75) Inventors: Naoki Nakano, Kanagawa (JP); Shigetoshi Hosaka, Kanagawa (JP); Takashi Kimura, Kanagawa (JP); Yoshihisa Ohta, Tokyo (JP); Toshihito Kamei, Tokyo (JP); Masakazu Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/704,250

(22) Filed: Feb. 11, 2010

(65) Prior Publication Data

US 2010/0141707 A1 Jun. 10, 2010

Related U.S. Application Data

(63) Continuation of application No. 11/630,219, filed as application No. PCT/JP2006/308925 on Apr. 21, 2006, now Pat. No. 7,690,763.

(30) Foreign Application Priority Data

May 17, 2005 (JP) ..... 2005-144016

(51) Int. Cl.
*B41J 2/135* (2006.01)

(52) U.S. Cl. ..... 347/44; 347/15; 347/40

(58) Field of Classification Search ..... 347/20, 347/40, 42, 43, 44, 47, 61–65, 67, 15
See application file for complete search history.

(56) References Cited

U.S. PATENT DOCUMENTS 6,827,423 B1 * 12/2004 Katakura et al. ..... 347/40
7,621,621 B2 * 11/2009 Iwasaki et al. ..... 347/43
2002/0008729 A1 1/2002 Kaneko et al.
2004/0233246 A1 11/2004 Takeushi (Continued)

FOREIGN PATENT DOCUMENTS

CN 1572515 A 2/2005

(Continued)

OTHER PUBLICATIONS

Aug. 29, 2008 official action (and English translation thereof) in connection with counterpart Chinese patent application No. 2006800005117.

(Continued)

*Primary Examiner* — Juanita D Jackson
(74) *Attorney, Agent, or Firm* — Cooper & Dunham LLP

(57) ABSTRACT

An imaging apparatus is disclosed that includes plural heads that are arranged in a main scanning direction, the heads including plural nozzle arrays that are arranged in the main scanning direction and configured to discharge droplets of recording liquids in at least three different colors including a yellow recording liquid. At least two of the nozzle arrays that are configured to discharge the yellow recording liquid are separately arranged in at least two of the heads. At least two of the nozzle arrays that are configured to discharge a first recording liquid of the recording liquids in a first color other than yellow are arranged together in one of the heads. At least two of the nozzle arrays that are configured to discharge a second recording liquid of the recording liquids in a second color other than yellow are arranged together in one of the heads.

17 Claims, 15 Drawing Sheets

U.S. PATENT DOCUMENTS

2005/0018012 A1 1/2005 Iwasaki et al.

FOREIGN PATENT DOCUMENTS

| | | |
|---|---|---|
| JP | 7-112534 | 5/1995 |
| JP | 8-295034 | 11/1996 |
| JP | 2000-79681 | 3/2000 |
| JP | 2001-96770 | 4/2001 |
| JP | 2001-96771 | 4/2001 |
| JP | 2001-113736 | 4/2001 |
| JP | 2001-130033 | 5/2001 |
| JP | 2001-171119 | 6/2001 |
| JP | 2001-205828 | 7/2001 |
| JP | 2001-232826 | 8/2001 |
| JP | 2002-137421 | 5/2002 |
| JP | 2003-118150 | 4/2003 |
| JP | 2003-237046 | 8/2003 |
| JP | 2003-266749 | 9/2003 |
| JP | 2004-106538 | 4/2004 |
| JP | 2005-1337 | 1/2006 |

OTHER PUBLICATIONS

Feb. 22, 2011 Japanese official action in connection with a counterpart Japanese patent application.

* cited by examiner

FIG.13

| | | SENSORY EVALUATION (μm) | | COLOR MEASUREMENT EVALUATION (μm) |
|---|---|---|---|---|
| | | CHARACTER QUALITY | LINE | GRADATION |
| SINGLE COLOR | K | 15 | 30 | 30 |
| | C | 25 | AT LEAST 50 | AT LEAST 50 |
| | M | 30 | AT LEAST 50 | AT LEAST 50 |
| | Y | 40 | AT LEAST 50 | AT LEAST 50 |
| SECONDARY COLOR | R | 60 | AT LEAST 50 | 40 |
| | G | 60 | AT LEAST 50 | AT LEAST 50 |
| | B | 40 | AT LEAST 50 | 30 |

FIG.17

| | | SENSORY EVALUATION (μm) | | COLOR MEASUREMENT EVALUATION (μm) |
|---|---|---|---|---|
| | | CHARACTER QUALITY | LINE | GRADATION |
| SINGLE COLOR | K | 15 | 30 | 30 |
| | C | 25 | AT LEAST 50 | AT LEAST 50 |
| | M | 30 | AT LEAST 50 | AT LEAST 50 |
| | Y | 40 | AT LEAST 50 | AT LEAST 50 |
| | R | 20 | 40 | 40 |
| | G | 30 | AT LEAST 50 | 30 |
| | B | 30 | AT LEAST 50 | 40 |

COLOR IMAGING APPARATUS HAVING YELLOW NOZZLE ARRAY AND MAGENTA NOZZLE ARRAY ON SAME HEAD AND SHIFTED RELATIVE TO EACH OTHER BY A HALF-PITCH

CROSS-REFERENCE TO RELATED APPLICATIONS

This application is a Rule 1.53(b) continuation of application Ser. No. 11/630,219, filed Dec. 19, 2006 (now U.S. Pat. No. 7,690,763) as a U.S. national phase application under 35 U.S.C. 371 of International Application No. PCT/JP2006/308925 filed Apr. 21, 2006, the entire contents of each of which are incorporated by reference herein.

TECHNICAL FIELD

The present invention relates to an imaging apparatus that implements liquid discharge heads in a recording head for discharging droplets of recording liquid.

BACKGROUND ART

An imaging apparatus such as a printer, a facsimile machine, a plotter, or a printer/fax/copier multifunction machine may correspond to a serial imaging apparatus that includes a carriage having a recording head that is made up of one or more liquid discharge heads configured to discharge droplets of recording liquid (e.g., ink), for example. The serial imaging apparatus is configured to serially scan the carriage in a direction perpendicular to a conveying direction of a recording medium (also referred to as 'paper' hereinafter although the recording medium is not limited to paper and may be made of some other suitable material), and intermittently convey the recording medium according to a recording width. In other words, the serial imaging apparatus is configured to alternate between conveying the recording medium and recording an image on the recording medium to realize imaging (also referred to recording or printing).

When bidirectional printing that involves forming an image in two different directions, namely an outward direction and a homeward direction, is realized by the carriage of the serial imaging apparatus, the order in which colors are discharged is reversed between the case of recording in the outward direction and the case of recording in the homeward direction, and color density unevenness may occur in bands (bidirectional color difference) as a result of the difference in the color discharging order. In this respect, various measures are implemented in order to reduce such bidirectional color difference.

As a first example, Japanese Laid-Open Patent Publication No. 2001-205828 discloses an apparatus having two sets of heads that are arranged to be symmetric to each other with respect to a scanning direction, each set of heads being configured to discharge cyan (C), magenta (M), and yellow (Y) inks to form a relatively large dot or a relatively small dot, the apparatus being characterized by altering the ink discharging order (e.g., C→M and M→C) in forming plural secondary color level pixels arranged in the raster direction so that there will be no difference in the discharging order depending on whether scanning is performed in the outward direction or homeward direction and color unevenness caused by the difference in the discharging order may be reduced. It is noted that similar disclosures are also made in Japanese Laid-Open Patent Publication No. 2002-137421, Japanese Laid-Open Patent Publication No. 2001-96770, Japanese Laid-Open Patent Publication No. 2001-96771, and Japanese Laid-Open Patent Publication No. 2001-130033.

As a second example, Japanese Laid-Open Patent Publication No. 8-295034 discloses an imaging apparatus including a first head having discharge heads respectively for cyan, magenta, and yellow arranged in this order, and a second head having discharge heads for the above colors arranged in a reverse order, which first and second heads are arranged to be symmetric to each other with respect to the main scanning direction with an array of black discharge heads disposed in between the first and second heads, the first head being used to discharge ink upon scanning in the outward direction, and the second head being used to discharge ink upon scanning in the homeward direction.

As a third example, Japanese Laid-Open Patent Publication No. 2000-79681 discloses an imaging apparatus including a first head that has discharge units for discharging the different types of inks used in the apparatus that are arranged in the recording medium conveying direction and are configured to acquire image characteristics information pertaining to image characteristics of input image information; and a second head that has discharge units identical to those of the first head that are arranged to be symmetric to the discharge units of the first head; wherein recording dots based on the input image information are assigned to the first head and the second head based on the image characteristic information by a multi-path data generating unit; multi-path recording of the first head is controlled by a first head control unit according to first recording dots; and multi-path recording of the second head is controlled by a second head control unit according to second recording dots.

As a fourth example, Japanese Laid-Open Patent Publication No. 2001-113736 discloses an inkjet head that is used in a serial scanning inkjet recording apparatus in which inkjet head plural nozzle arrays each corresponding to ink that can be discharged are arranged in parallel with respect to the scanning direction, wherein at least three nozzle arrays for discharging at least two types of ink are aligned in the same order with respect to the outward scanning direction and the homeward scanning direction.

As a fifth example, Japanese Laid-Open Patent Publication No. 2001-171119 discloses a liquid discharge head that discharges a first liquid and a second liquid that is of a different type from the first liquid from differing discharge outlets to realize recording, the liquid discharge head including a first discharge outlet array group made up of plural discharge outlet arrays each having plural discharge outlets arranged at a predetermined pitch in a direction that is different from the scanning direction which arrays are arranged such that corresponding discharge outlets of the discharge outlet arrays are brought in line with respect to the scanning direction; and a second discharge outlet array group made up of discharge outlets having a similar configuration to that of the first discharge outlet array group that is arranged next to the first discharge outlet array group; wherein the first discharge outlet array group includes a first discharge outlet array for discharging a first liquid and a second discharge outlet array for discharging a second liquid; the second discharge array group includes a third discharge outlet array for discharging the first liquid and a fourth discharge outlet array for discharging the second liquid; and the first discharge outlet array group and the second discharge outlet array group are arranged such that the first discharge outlet array and the third discharge outlet array are adjacent to each other, and the discharge outlets forming the first discharge outlet array and the discharge outlets forming the third discharge outlet array are shifted in their alignment direction so that they complement each other with respect to the scanning direction.

As a sixth example, Japanese Laid-Open Patent Publication No. 7-112534 discloses an imaging apparatus including means for conveying a recording medium and a carriage having ink tanks and a head that outputs input image information onto the recording medium by discharging ink from plural nozzles, the nozzles being divided into at least two nozzle groups that are connected to different ink tanks.

As a seventh example, Japanese Laid-Open Patent Publication No. 2003-266749 discloses an imaging apparatus that uses gamma correction to reduce color phase variations caused by the difference in the color discharging order between outward direction recording and homeward direction recording of a print head.

However, in the first example where two sets of heads that discharge dots of differing sizes are symmetrically arranged and the ink discharging order is altered to realize recording in the same ink discharging order for the outward direction and the homeward direction, and in the second through fourth examples where differing heads or nozzle arrays are used for the outward direction and the homeward direction, even when the ink discharging order may be the same, color differences may occur between recording in the outward direction and the homeward direction due to variations in the amount of ink discharged by the different heads.

In the fifth example where a liquid discharge head is used that includes first and second discharge outlet array groups each having plural discharge outlet arrays that are arranged such that corresponding discharge outlets of the discharge outlet arrays are brought in line with respect to the scanning direction, and the pitches of the first discharge outlet array group and the second discharge outlet array group are shifted from each other with respect to a direction perpendicular to the scanning direction, the head structure becomes complicated to thereby result in an increase in manufacturing costs.

In the sixth example where plural nozzles of a head are divided into two nozzle groups that are connected to different ink tanks, two mechanisms for supplying ink have to be provided so that the head structure becomes complicated and large, and the structure of a mechanism for positioning the head may also be complicated and large. Further, there may be an increase in the amount of discarded ink that is discharged for preventing the mixing of color ink and black ink upon simultaneously performing maintenance of the nozzles for the color ink and the black ink.

In the seventh example where gamma correction is used to reduce color phase variations caused by the difference in the ink discharging order between recording in the outward direction and the homeward direction, the gamma correction process may be complicated.

SUMMARY

In an aspect of this disclosure, there is provided an imaging apparatus that can attain high image quality by reducing bidirectional color difference, facilitating installation adjustment of the recording head, and reducing image degradation caused by deviations in the manufacture and installation of the recording head, for example.

In another aspect, there is provided an imaging apparatus that includes:

plural heads that are arranged in a main scanning direction, the heads including plural nozzle arrays that are arranged in the main scanning direction and configured to discharge droplets of recording liquids in at least three different colors including a yellow recording liquid;

wherein at least two of the nozzle arrays that are configured to discharge the yellow recording liquid are separately arranged in at least two of the heads;

at least two of the nozzle arrays that are configured to discharge a first recording liquid of the recording liquids in a first color other than yellow are arranged together in one of the heads; and at least two of the nozzle arrays that are configured to discharge a second recording liquid of the recording liquids in a second color other than yellow are arranged together in one of the heads.

In a preferred embodiment, the at least two nozzle arrays configured to discharge the first recording liquid are arranged to be adjacent to each other; and the at least two nozzle arrays configured to discharge the second recording liquid are arranged to be adjacent to each other.

In another aspect, an imaging apparatus is provided that includes:

plural heads that are arranged in a main scanning direction, the heads including plural nozzle arrays that are arranged in the main scanning direction and configured to discharge droplets of recording liquids in at least three different colors including a yellow recording liquid;

wherein at least two of the nozzle arrays that are configured to discharge the yellow recording liquid are separately arranged in at least two of the heads;

at least two of the nozzle arrays that are configured to discharge a first recording liquid of the recording liquids in a first color other than yellow are arranged to be adjacent to each other; and at least two of the nozzle arrays that are configured to discharge a second recording liquid of the recording liquids in a second color other than yellow are arranged to be adjacent to each other.

In a preferred embodiment, at least one of the first recording liquid and the second recording liquid corresponds to a black recording liquid. In another preferred embodiment, at least one of the first recording liquid and the second recording liquid corresponds to at least one of a cyan recording liquid, a magenta recording liquid, a red recording liquid, a blue recording liquid, and a green recording liquid. According to another preferred embodiment, the at least two of the nozzle arrays configured to discharge the same recording liquid are shifted from each other with respect to a direction perpendicular to the main scanning direction by a distance equal to (1/number of nozzle arrays configured to discharge the same recording liquid)×nozzle pitch of the nozzle arrays.

According to another preferred embodiment, the heads use an electrothermal transducing element or an electromechanical transducing element configured to generate pressure for discharging the recording liquids.

According to another preferred embodiment, an extent of landing position deviation between recording liquid droplets discharged from the nozzle arrays is arranged to be no more than 30 μm. According to another preferred embodiment, when an image to be formed corresponds to an image that is normally realized by using the first recording liquid and the second recording liquid simultaneously, at least one of the first recording liquid and the second recording liquid is refrained from being used. Further, in this case, the first recording liquid and the second recording liquid are preferably used simultaneously when the image to be formed has a brightness below 26.

BRIEF DESCRIPTION OF THE DRAWINGS

The aforementioned and other aspects, features and advantages will become more apparent from the following detailed description when read in conjunction with the accompanying drawings.

FIG. 13 is a table indicating exemplary determinations of the extent of landing position deviations allowed in view of a desired image quality based on a sensory evaluation in a four-color head configuration;

FIG. 17 is a table indicating exemplary determination results of the extent of landing position deviations allowed in view of a desired image quality based on a sensory evaluation in a six-color head configuration.

BEST MODE FOR CARRYING OUT THE INVENTION

In the following, preferred embodiments of the present invention are described with reference to the accompanying drawings.

Figure 1:
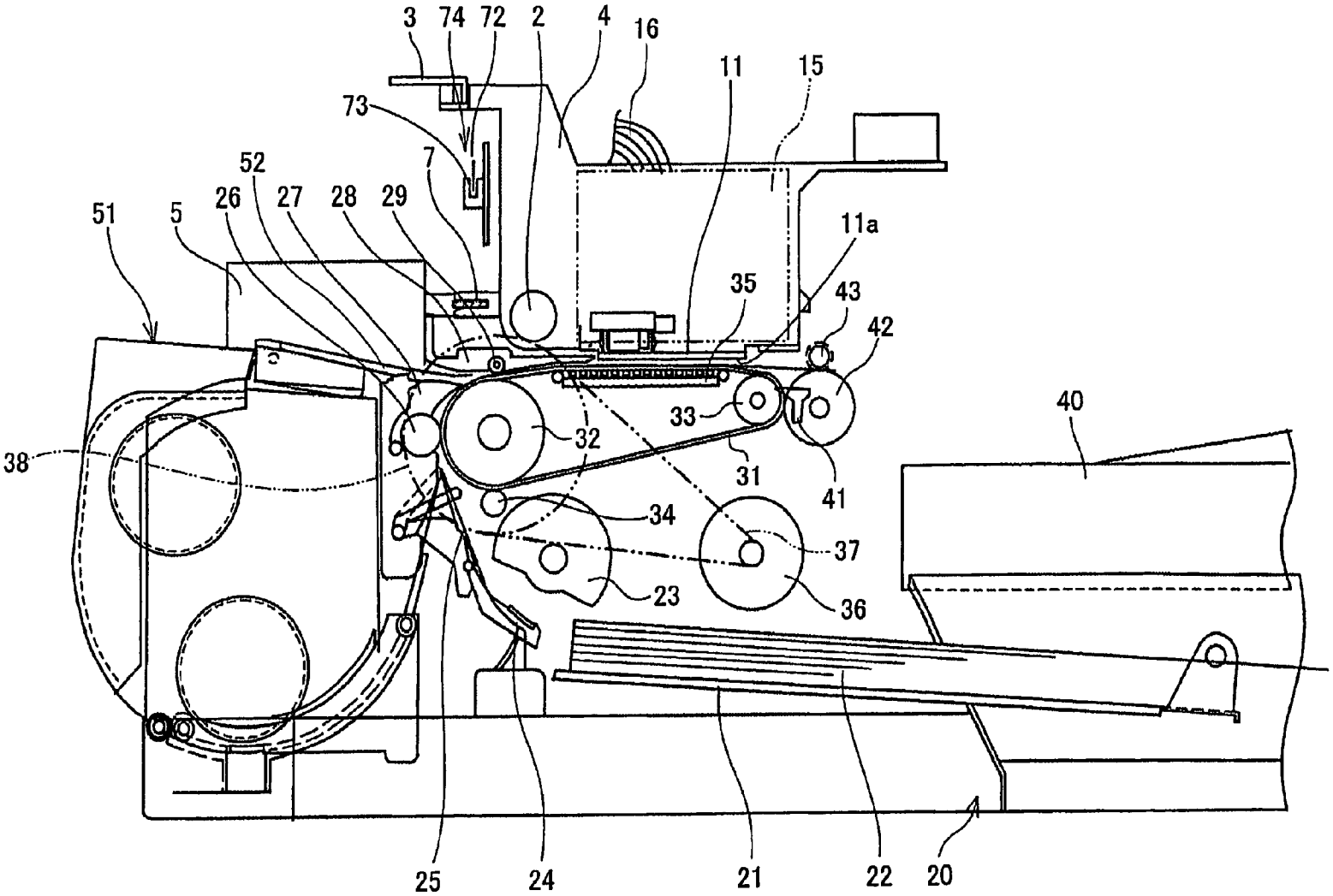
FIG. 1 is a side view of an imaging apparatus according to an embodiment of the present invention.
Figure 2:
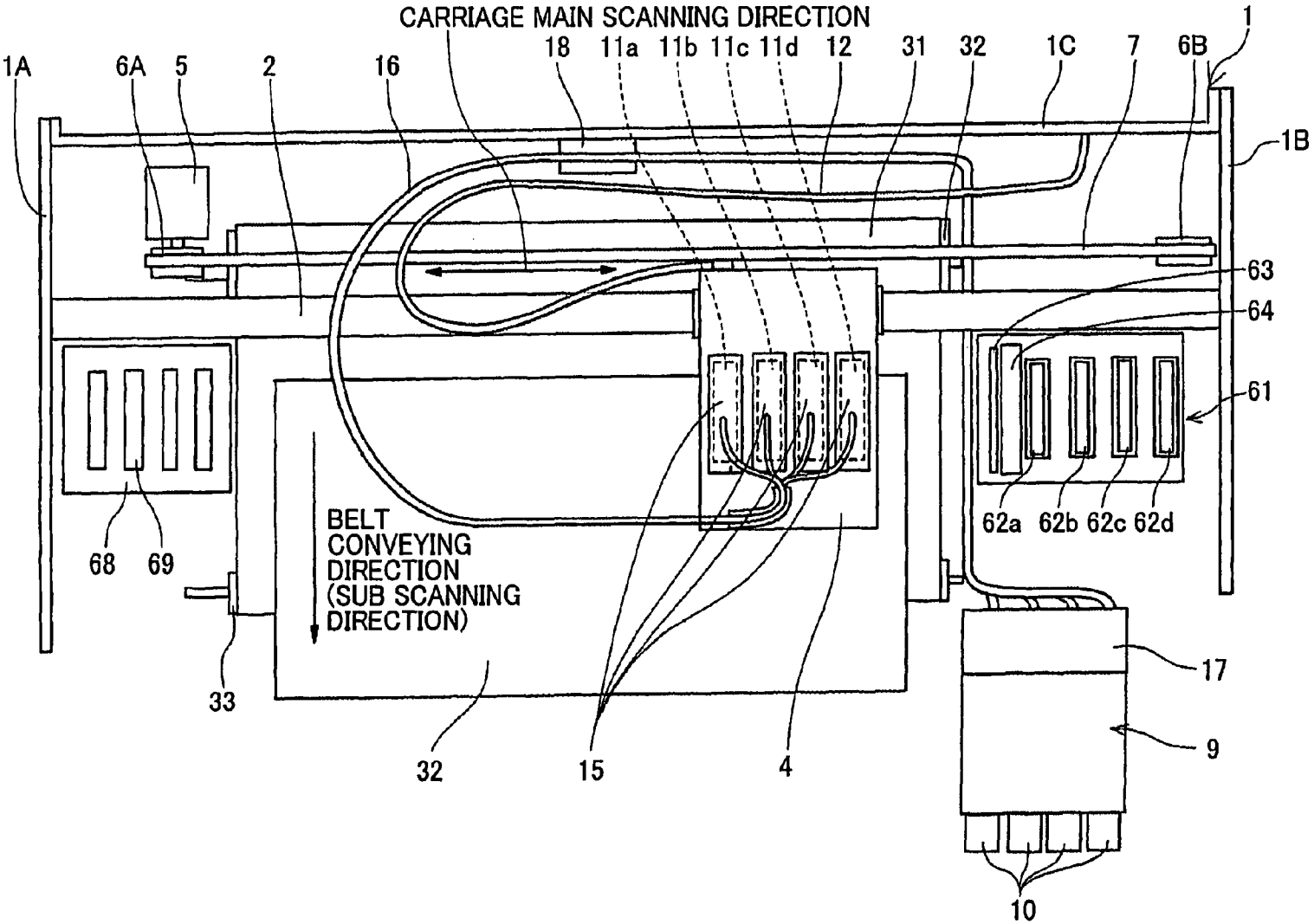
FIG. 2 is a plan view of the imaging apparatus shown in FIG. 1.

First, an imaging apparatus according to an embodiment of the present invention is described with reference to FIGS. 1 and 2. It is noted that FIG. 1 is a side view of the imaging apparatus according to the present embodiment and FIG. 2 is a plan view of the imaging apparatus according to the present embodiment.

The imaging apparatus of the illustrated embodiment includes a frame 1 having side boards 1A and 1B, a guide rod 2 that is suspended between the side boards 1A and 1B, a stay 3, a carriage 4 that is supported by the guide rod 2 and the stay 3 to slide freely in the main scanning direction, a main scanning motor 5, a drive pulley 6A, a driven pulley 6B, and a timing belt 7 that is wound around the drive pulley 6A and the driven pulley 6B, the carriage 4 being moved in the main scanning direction (see arrow of FIG. 2) by the main scanning motor 5 via the timing belt 7.

The carriage 4 includes four heads 11*a*-11*d* realized by liquid discharge heads that are configured to discharge inks in colors cyan (C), magenta (M), yellow (Y), and black (K), for example. The heads 11*a*-11*d* each have a nozzle surface on which plural nozzle arrays are arranged in the main scanning direction, each of the nozzle arrays having plural ink discharging outlets (nozzles) aligned in a direction perpendicular to the main scanning direction (sub scanning direction). The nozzle surfaces of the heads 11*a*-11*d* are disposed so that the ink discharging direction of the nozzles is directed downward. In the following descriptions, the heads 11*a*-11*d* are collectively referred to as 'recording head 11'.

It is noted that in the illustrated embodiment, the liquid discharge heads 11*a*-11*d* making up the recording head 11 correspond to inkjet heads that use a piezoelectric actuator as pressure generating means for generating pressure to discharge liquid droplets. However, the present invention is not limited to such an embodiment, and in another example, a thermal resistor element may be used.

Also, it is noted that the recording head 11 includes a driver IC, and is connected to a control unit (not shown) via a harness (flexible printer cable: FPC) 12 (see FIG. 2).

The carriage 4 includes a sub tank 15 for each color configured to supply the corresponding color ink to the recording head 11. The corresponding color ink is supplied to each sub tank 15 from a corresponding cartridge 10 that is arranged in a cartridge loading unit 9 via a corresponding ink supply tube 16. The cartridge loading unit 9 includes a supply pump unit 17 for transferring ink within the ink cartridge 10. The ink supply tube 16 has an intermediate section that engages a back plate 1C by an engaging member 18 (see FIG. 2).

The imaging apparatus of the present embodiment has a paper feeding part including a paper feeding tray 20, a paper stacking plate 21, a paper feeding roller 23 for separately feeding each sheet of paper 22 stacked on the paper stacking plate 21, and a separating pad 24 made of a material having a large friction coefficient that is arranged opposite the paper feeding roller 23 and applies a force toward the paper feeding roller 23.

Also, the imaging apparatus of the present embodiment includes a guide member 25 for guiding the paper 22 fed from the paper feeding part to convey the paper to a position beneath the recording head 11, a counter roller 26, a conveying guide member 27, a holding member 28 having a tip pressurizing collar 29, and a conveying belt 31 configured to have the paper 22 fed from the paper feeding part electrostatically adhered thereto for conveying the paper 22 to a position opposing the recording head 11 (see FIG. 1).

The conveying belt 31 is a continuous belt that is arranged around a conveying roller 32 and a tension roller 33 and is configured to rotate in a belt conveying direction (sub scanning direction). The conveying belt 31 is charged by a charge roller 34 while rotating in the sub scanning direction.

It is noted that the conveying belt 31 may have a single layer structure or a multi-layer structure (with at least two layers). In a case where the conveying belt 31 has a single layer structure, the conveying belt 31 comes into contact with the paper 22 and the charge roller 34, and thereby the entire belt layer is preferably made of an insulating material. In a case where the conveying belt 31 has a multi-layer structure, the layer that comes into contact with the paper 22 and the charge roller 34 is preferably made of an insulating material while the layer(s) that does not come into contact with the paper 22 and the charge roller 34 is preferably made of conductive material.

The insulating material of the conveying belt 31 having a single layer structure or the insulating material of the insulating layer of the conveying belt 31 which belt has a multi-layer structure may be resin such as PET, PEI, PVDF, PC, ETFE, PTFE, or elastomer material that does not include conduction control material, for example. The volume resistance of the insulating material is preferably at least $10^{12}$ Ωcm and more preferably $10^{15}$ Ωcm. Also, the conductive material of the conductive layer of the conveying belt 31 having a multi-layer structure may be a material made of resin or elastomer as is described above with carbon added thereto to realize a volume resistance preferably within a range of $10^5$ Ωcm to $10^7$ Ωcm.

The charge roller 34 comes into contact with the insulating layer of the conveying belt 31 (in the case where the conveying belt 31 has a multi-layer structure), and is arranged to be driven by the rotating movement of the conveying belt 31. A pressing force is applied to both ends of the rotational axis of the charge roller 34. The charge roller 34 is preferably made of a conductive material having a volume resistance of $10^6$-$10^9$ Ωcm/□. An AC bias (high voltage) for positive and negative electrodes at 2 kV, for example, is applied to the charge roller 34 from an AC bias supplying unit (high voltage power source) as is described in detail below. The AC bias may be a sine wave or a triangular wave, for example, but is preferably a square wave.

As is shown in FIG. 1, a guide member 35 is arranged at the rear side of the conveying belt 31 at a position corresponding to the printing region for the recording head 11. The upper surface of the guide member 35 is raised toward the recording head 11 with respect to the tangential line formed by the two rollers (conveying roller 32 and tension roller 33) supporting the conveying belt 31 so as to maintain the precise planarity of the conveying belt 31.

The conveying belt 31 is rotated in the belt conveying direction (sub scanning direction) as is shown in FIG. 2 by the rotation of the conveying roller 32 that is driven to rotate by a sub scanning motor 36, a drive belt 37, and a timing roller 38 (see FIG. 1). It is noted that an encoder wheel (not shown) having slits formed thereon is attached to the rotational axis of the conveying roller 32, and a transparent photo sensor (not shown) is arranged to detect the slit of the encoder wheel, the encoder wheel and the photo sensor making up a wheel encoder.

Also, the imaging apparatus of the present embodiment includes a separating pick 41, a delivery roller 42, and a delivery collar 43 as a delivery unit for delivering paper 22 having an image recorded by the recording head 11 to a delivery tray 40.

Further, a dual side printing unit 51 is detachably arranged at the rear side of the frame 1 (see FIG. 1). The dual side printing unit 51 is configured to receive paper 22 that is carried in a reverse direction through reverse rotation of the conveying belt 31, and turn the received paper 22 over to the other side to feed the paper 22 once more between the counter roller 26 and the conveying belt 31. Also, a manual paper feed tray 52 is arranged at the upper side of the dual side printing unit 51.

It is noted that a maintenance restoration mechanism 61 for maintaining and restoring the nozzles of the recording head 11 is arranged at a position corresponding to a non-printing region on one side with respect to the scanning direction of the carriage 4. The maintenance restoration mechanism 61 includes cap members 62*a*-62*d* (also referred to as 'cap 62' hereinafter) for capping the nozzle surfaces of the recording head 11; a wiper blade 63 corresponding to a blade member for wiping the nozzle surfaces 11*a*; and an air discharge receiver 64 configured to receive liquid droplets discharged through air discharge which is unrelated to image recording and is performed in order to discharge thickened recording liquid, for example. In the present example, cap 62A corresponds to a suction and moisture retention cap, and the caps 62*b*-62*d* correspond to moisture retention caps.

Also, an air discharge receiver 68 for receiving liquid droplets discharged through air discharge which is unrelated to image recording and is performed in order to discharge recording liquid that is thickened during recording, for example, is arranged at a position corresponding to a non-printing region on the other side with respect to the scanning direction of the carriage 4. The air discharge receiver 68 has openings 69 extending in the alignment direction of the nozzle array of the recording head 11, for example (see FIG. 2).

As is shown in FIG. 1, an encoder scale 72 having slits formed thereon is arranged at the front side of the carriage 4 along the main scanning direction, and an encoder sensor 73 including a transparent sensor configured to detect the slit of the encoder scale 72 is also arranged at the front side of the carriage 4. The encoder scale 72 and the encoder sensor 73 realize a linear encoder 74 for detecting the main scanning position of the carriage 4.

Figure 3:
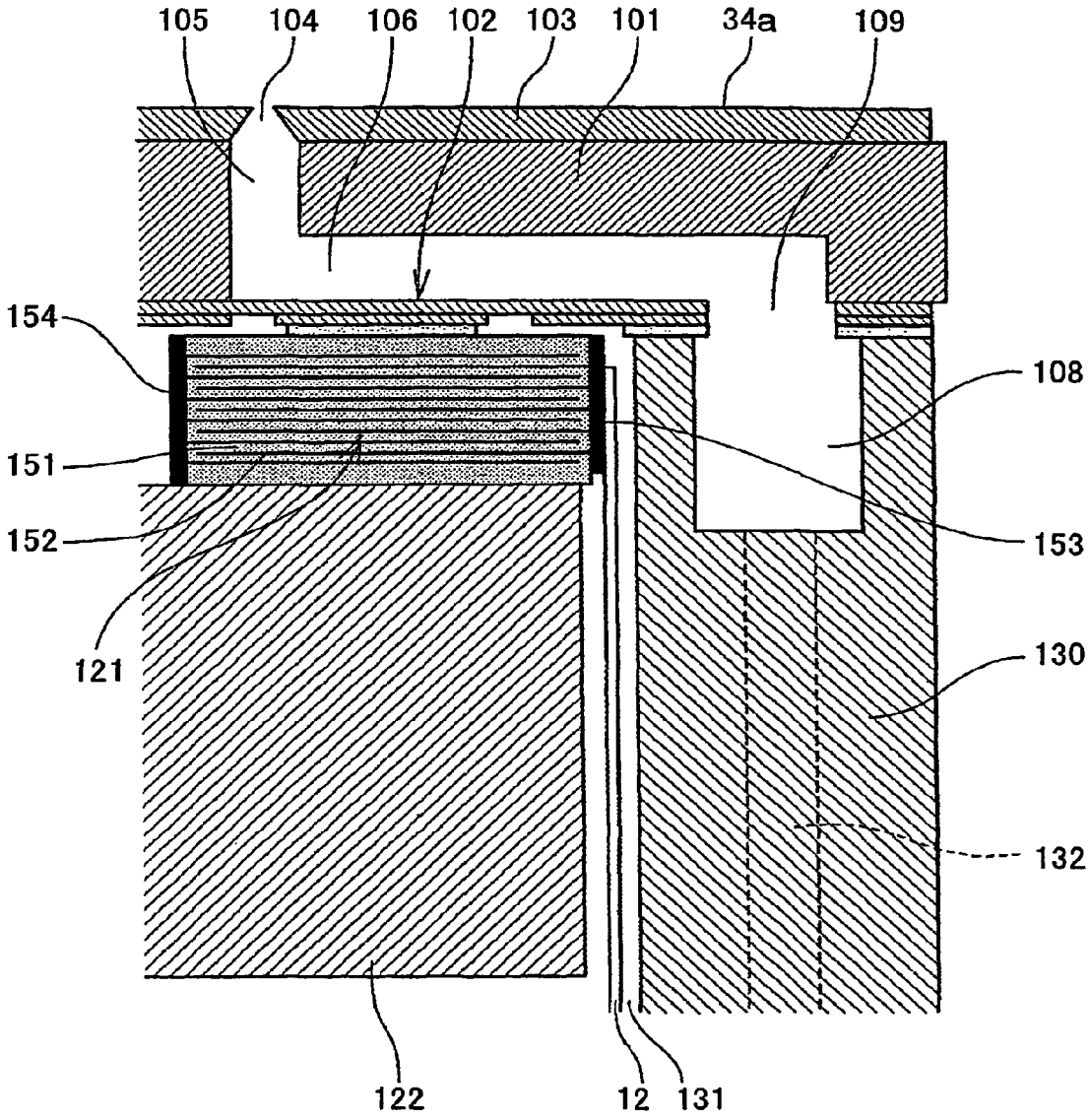
FIG. 3 is a cross-sectional diagram of a liquid discharge head realizing a recording head of the imaging apparatus shown in FIG. 1 cut across a longer side of a liquid chamber.
Figure 4:
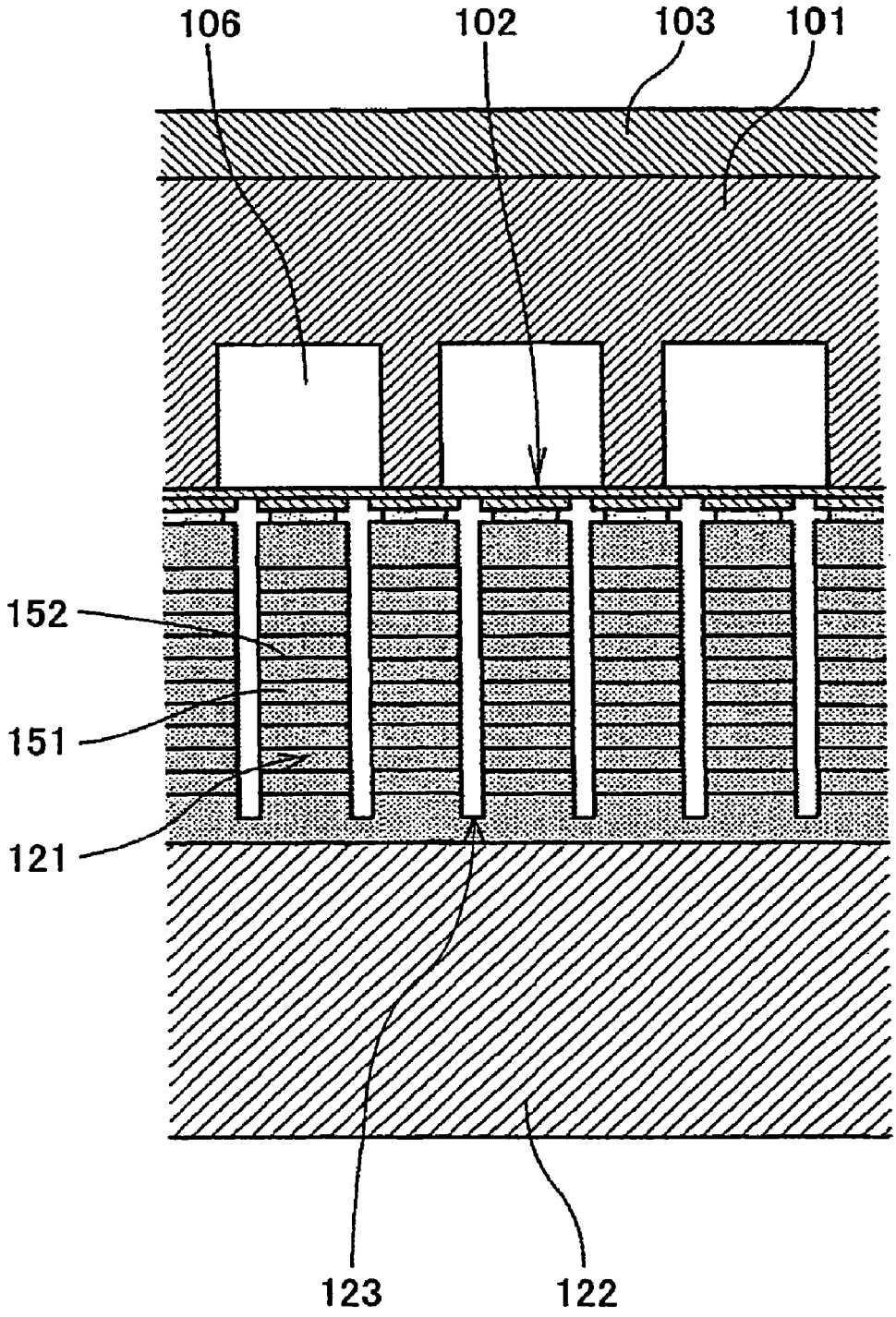
FIG. 4 is a cross-sectional diagram of the liquid discharge head shown in FIG. 3 cut across a shorter side of the liquid chamber.

FIGS. 3 and 4 are diagrams illustrating an exemplary configuration of the liquid discharge head realizing the recording head 11 of the imaging apparatus according to the present embodiment. It is noted that FIG. 3 is a cross-sectional view of a liquid discharge head cut across the direction of a longer side of a liquid chamber, and FIG. 4 is a cross-sectional view of the liquid discharge head cut across the direction of a shorter side of the liquid chamber (nozzle alignment direction).

The illustrated liquid discharge head includes a flow path plate 101 that is created by performing anisotropic etching on a single crystal silicon substrate, for example; a vibrating plate 102 that is created through nickel electroplating, for example, and is adhered to the lower surface of the flow path plate 101; and a nozzle plate 103 that is adhered to the upper surface of the flow path plate 101. The nozzle plate 103, the flow path plate 101, and the vibrating plate 102 form a nozzle connecting flow path 105 connected to a nozzle 104 that discharges liquid droplets (ink droplets), a liquid chamber 106, and an ink supply opening 109 connected to a common liquid chamber 108 for supplying ink to the liquid chamber 106, for example.

Also, the liquid discharge head includes two rows of deposited piezoelectric elements 121 (only one row is shown in FIG. 4) as an electromechanical transducing element corresponding to pressure generating means (actuator) for deforming the vibrating plate 102 and applying pressure to ink within the liquid chamber 106, and a base substrate 122 that fixes the piezoelectric elements 121. It is noted that column elements 123 are arranged between the piezoelectric elements as is shown in FIG. 4. The column elements 123 may be created simultaneously with the piezoelectric elements 121 through divisional processing. However, a drive voltage is not applied to the column elements 123.

The piezoelectric element 121 is connected to a cable 12 (see FIG. 3) that includes a drive circuit (not shown).

The peripheral portion of the vibrating plate 102 is connected to a frame member 130, and the frame member 130 realizes a through hole portion 131, a concave portion corresponding to the common liquid chamber 108 and an ink supply hole 132 for supplying ink to the common liquid chamber 108 from an external unit. The frame member 130 may be made using thermally cured resin such as epoxy resin or through injection molding using polyphenylene sulfide, for example.

The flow path plate 101 may be formed by performing anisotropic etching on a single crystal silicon substrate with (110) crystal orientation using alkaline etching liquid such as a potassium hydroxide solution, for example, to create a concave portion and a hole portion that form the nozzle connecting flow path 105 and the liquid chamber 106, for example. However, it is noted that the present invention is not limited to such an example, and in other embodiments, a stainless substrate or a photoconductive resin substrate may be used instead of a single crystal silicon substrate to realize the flow path plate 101.

The vibrating plate 102 may be created by performing an electroforming (electrotyping) process on a nickel plate, for example. However, in other examples, some other metal plate or a metal and resin combined plate may be used. It is noted that the piezoelectric elements 121 and the column members 123 are adhered to the vibrating plate 102 with adhesive, and the frame member 130 is adhered to the peripheral portion of the vibrating plate 102 with adhesive.

The nozzle plate 103 forms a nozzle 104 having a diameter of 10-30 μm corresponding to each liquid chamber 106, and is adhered to the flow path plate 101 with adhesive. The nozzle plate 103 is formed by depositing one or more layers as is necessary or desired on the surface of a nozzle forming member made of metal and arranging the uppermost layer to be a water repellant layer. It is noted that the upper surface of the nozzle plate 103 may correspond to the nozzle surface as is described above.

The piezoelectric element 121 is formed by alternatingly depositing a piezoelectric material 151 and an internal electrode 152 (corresponding to a PZT in the present example). It is noted that an individual electrode 153 and a common electrode 154 arranged at opposited ends of the piezoelectric element 121 are connected to alternating internal electrodes 152. In the illustrated example, the piezoelectric element 121 is configured to apply pressure to ink contained within a corresponding pressurizing liquid chamber 106 using displacement in the piezoelectric constant d33 direction; however, the present invention is not limited to such an example, and the piezoelectric element 121 may be configured to apply pressure to ink contained within a corresponding pressurizing liquid chamber 106 using the displacement in the piezoelectric constant d31 direction as well. Also, in another example, one row of the piezoelectric element 121 may be arranged on one substrate 122.

In the illustrated liquid discharge head, for example, by decreasing the voltage applied to the piezoelectric element 121 with respect to a reference voltage, the piezoelectric element 121 may contract and the vibrating plate 102 may be lowered so that the volume of the liquid chamber 106 may expand to induce ink to flow into the liquid chamber 106. Then, the voltage applied to the piezoelectric element 121 may be increased so that the piezoelectric element 121 may expand in the depositing direction to cause deformation of the vibrating plate 102 in the nozzle 104 direction and contraction of the liquid chamber 106. In this way, the recording liquid contained within the liquid chamber 106 may be pressurized, and one or more droplets of the recording liquid may be discharged from the nozzle 104.

Then, by setting the voltage applied to the piezoelectric element 121 back to the reference voltage, the vibrating plate 102 may be restored to its initial position and the liquid chamber 106 may expand so that a negative pressure is generated. As a result, recording liquid may be supplied to the liquid chamber 106 from the common liquid chamber 108. After the vibration of the meniscus surface of the nozzle attenuates and stabilizes, operations may be started for realizing a next liquid droplet discharge.

It is noted that the head drive method for driving the liquid discharge head is not limited to the above-described example (i.e., pull-push actuation), and the pull actuation mode or the push actuation mode may alternatively be used, for example, depending on the manner in which the drive waveform is applied.

In the imaging apparatus according to the present embodiment, each sheet of paper 22 is separately fed from the paper feeding part to be guided upward by the guide 25 in an approximately vertical direction, inserted between the conveying belt 31 and the counter roller 26, and conveyed further so that the tip the fed paper 22 is guided by the conveying guide member 27 and pushed towards the conveying belt by the tip pressurizing collar 29 to thereby change the conveying direction of the paper 22 by approximately 90 degrees.

It is noted that positive and negative outputs from the AC bias supply unit (described in detail below) are alternatingly applied to the charge roller 34; that is, an alternating voltage is applied to the charge roller 34. In turn, an alternating charge voltage pattern is formed on the conveying belt 31; that is, positive and negative voltage charged strips having a predetermined width are alternatingly arranged in the sub scanning direction corresponding to the rotation direction of the conveying belt 31. When paper 22 is placed on the conveying belt 31 that is alternatingly charged with the positive and negative voltages, the paper 22 may be adhered to the conveying belt 31 through electrostatic attraction, and in this way, the paper 22 may be conveyed in the sub scanning direction by the rotating movement of the conveying belt 31.

According to the present embodiment, the recording head 11 may be driven according to an image signal while the carriage 4 is moved so that ink droplets may be discharged onto the paper 22, which paper 22 is maintained still, to thereby record one line image on the paper 22. Then, the paper 22 is moved in the sub scanning direction by a predetermined distance after which recording of the next line image may be performed. Then, when a recording end signal or a signal indicating that the rear end of the paper 22 has reached the recording region is received, the recording operation is ended and the paper 22 is delivered to the delivery tray 40.

In the case of realizing dual side printing, when image recording of the front side of the paper 22 is completed, the conveying belt 31 is rotated in a reverse direction so that the recorded paper 22 may be sent to the dual side printing unit 51 at which the paper 22 is turned over (so that the back side of the paper 22 becomes the printing surface), and the paper 22 may be inserted once more between the counter roller 26 and the conveying belt 31 so that image recording through timing control may be performed on the back side of the paper 22 in the manner described above after which the paper 22 may be delivered to the delivery tray 40.

Figure 5:
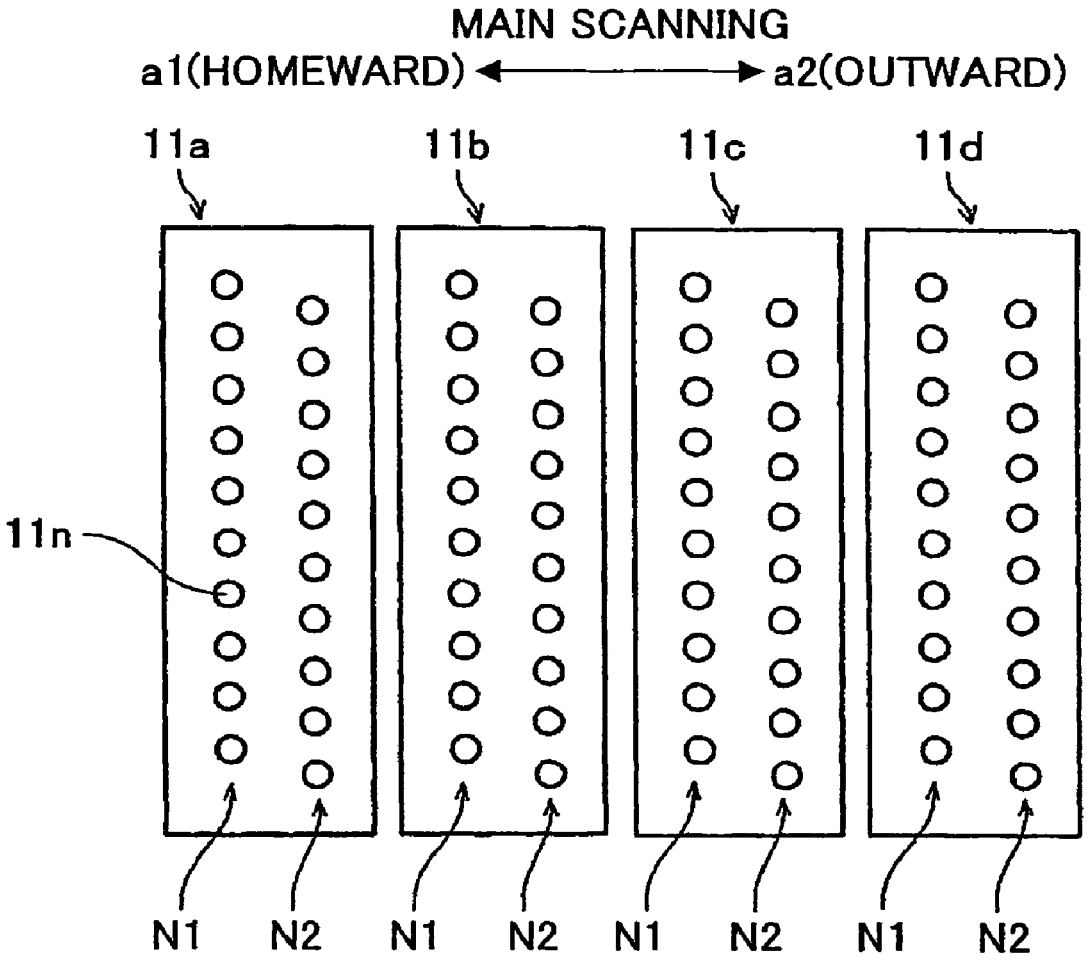
FIG. 5 is a diagram showing the recording head of the imaging apparatus of FIG. 1 viewed from a nozzle surface side.
Figure 6:
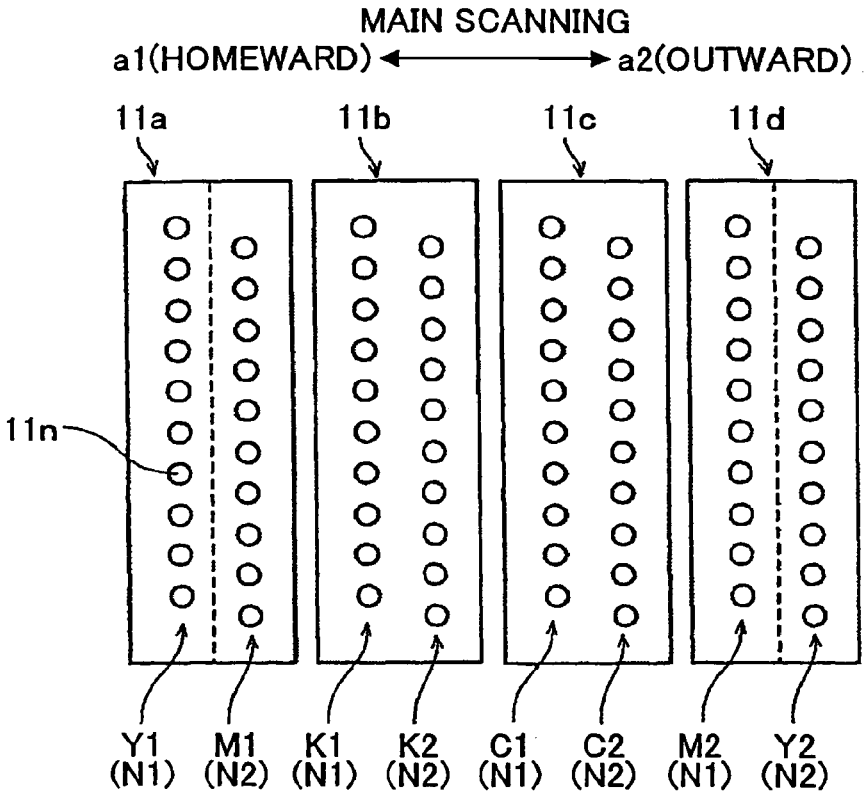
FIG. 6 is a diagram illustrating a color arrangement realized by nozzle arrays of the recording head shown in FIG. 5.

FIGS. 5 and 6 are diagrams illustrating an exemplary configuration of the nozzle arrays of the recording head 11 of the imaging apparatus according to the present embodiment.

As is shown in FIG. 5, the recording head 11 of the imaging apparatus according to the present embodiment includes four heads 11*a*-11*d* that each include nozzle arrays N1 and N2 that are arranged in the main scanning direction (arrow a2 representing the outward direction and arrow a1 representing the homeward direction in FIGS. 5 and 6). Each of the nozzle arrays N1 and N2 has plural nozzles 11*n* for discharging liquid droplets that are aligned in a direction perpendicular to the main scanning direction (sub scanning direction). It is noted that in the illustrated example, the respective nozzles 11*n* of the nozzle arrays N1 and N2 are shifted from each other in the sub scanning direction by ½ the nozzle pitch of these nozzles 11*n*.

As is shown in FIG. 6, the nozzle arrays N1 and N2 of the head 11*a* respectively correspond to a nozzle array Y1 for discharging yellow (Y) recording liquid droplets and a nozzle array M1 for discharging magenta (M) recording liquid droplets, the nozzle arrays N1 and N2 of the head 11*b* respectively correspond to nozzle arrays K1 and K2 for discharging black (K) recording liquid droplets, the nozzle arrays N1 and N2 of the head 11*c* respectively correspond to nozzle arrays C1 and C2 for discharging cyan (C) recording liquid droplets, and the nozzle arrays N1 and N2 of the head lid respectively correspond to a nozzle array M2 for discharging magenta (M) recording liquid droplets and a nozzle array Y2 for discharging yellow (Y) recording liquid droplets.

According to the present embodiment, of the four colors Y, M, C, and K, the nozzle arrays for discharging recording liquids in the two colors C and K that are relatively vulnerable to positional deviation (i.e., likely to cause image degradation due to landing position deviation) are not separately arranged in different heads (i.e., the nozzle arrays for discharging each color are arranged in the same head). The nozzle arrays for discharging the remaining colors yellow (Y) and magenta (M) are separately arranged in different heads.

In the present example, the nozzle arrays for discharging cyan (C) are arranged in the same head and the nozzle arrays for discharging black (K) are arranged in the same head, and the nozzle arrays for discharging the same color are arranged to be adjacent to each other.

Upon focusing on the nozzles N1 of the heads 11*a*-11*d* of the recording head 11, it can be appreciated that the heads 11*a*-11*d* of the recording head 11 realize a color arrangement order of Y, K, C, M from the upstream side of the outward moving direction (i.e., direction of arrow a2 in FIG. 6). Upon focusing on the nozzles N2 of the heads 11*a*-11*d* of the recording head 11, it can be appreciated that the heads 11*a*-11*d* of the recording head 11 realize a color arrangement order of M, K, C, Y. In other words, the order of the colors Y, M, and C for forming a color image is reversed between the nozzle arrays N1 and the nozzle arrays N2.

In the case of forming a color image using the colors C, M, Y or K, M, Y simultaneously with the recording head 11 as is described above, a raster formed in outward scanning and a raster formed in homeward scanning are interlaced so that high frequency color unevenness is generated in every recording raster in a complementary manner due to the difference in the discharging order to realize an image that appears to be even.

In this case, the nozzle arrays that discharge liquid droplets of the same color (e.g., nozzle arrays Y1 and Y2, nozzle arrays M1 and M2, nozzle arrays C1 and C2) are shifted with respect to each other by a distance of (1/number of nozzle arrays)× nozzle pitch (e.g., (½)×nozzle pitch) so that the nozzles N11 of the nozzle arrays may be arranged into a zigzag pattern. In this way, visual perceptibility of color unevenness may be reduced further upon realizing bidirectional printing.

As can be appreciated from the above descriptions, according to an embodiment of the present invention an imaging apparatus is provided that is capable of discharging at least three colors including yellow in which apparatus nozzle arrays for discharging yellow recording liquid droplets are separately arranged in different heads, and nozzle arrays for discharging recording liquid droplets in at least two colors other than yellow are arranged such that the nozzle arrays for discharging a recording liquid in each of the colors are not divided into separate heads. According to another embodiment of the present invention, an imaging apparatus is provided that is capable of discharging recording liquid droplets in at least three colors including yellow in which apparatus nozzle arrays for discharging yellow liquid droplets are separately arranged in different heads, and nozzle arrays for discharging recording liquid droplets in each of at least two colors other than yellow are arranged to be adjacent to each other. In these embodiments, visual perceptibility of bidirectional color differences may be reduced, and since nozzle arrays for discharging recording liquids in certain colors that are vulnerable to image degradation due to landing position deviation of the discharged recording liquid droplets are not divided into separate heads, installation procedures for installing the heads may be facilitated, and image degradation due to deviations in the manufacture and installation of the heads may be reduced.

In a preferred embodiment, since image degradation due to landing position deviations in the discharged recording liquid droplets may be prominent for black, the nozzle arrays for discharging black recording liquid are not divided into separate heads. In this way, image degradation due to deviations in the manufacture and installation of the head may be reduced further.

Figure 7:
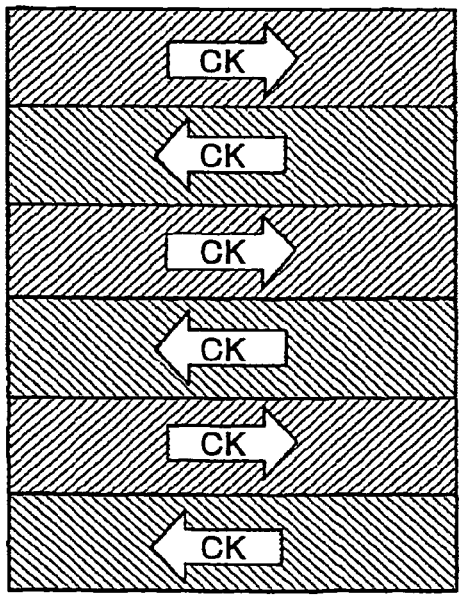
FIG. 7 is a diagram illustrating bidirectional color difference occurring when two or more colors that are each arranged to be discharged from nozzle arrays of the same liquid discharging head are used at the same time.

It is noted that in a case where the two colors other than yellow (i.e., C and K in the present example) are simultaneously used to form an image as opposed to using only one of C or K as is described above, a resulting image from bidirectional printing may not appear to be even; that is, color unevenness may occur in bands due to the difference in the discharging order between printing in the outward direction and printing in the homeward direction as is shown in FIG. 7.

Figure 8:
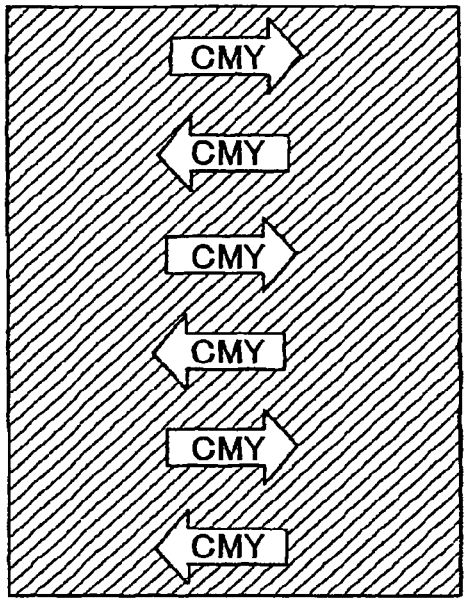
FIG. 8 is a diagram illustrating a reduction of bidirectional color difference realized when the two or more colors that are each discharged from nozzle arrays of the same liquid discharging head are not used at the same time.

In this respect, instead of using C and K at the same time, a combination of C, M, and Y that is the equivalent of K may be used in addition to C so that high frequency color unevenness is generated in every recording raster in a complementary manner to realize an image corresponding to the image to be formed using C and K that appears to be even as is shown in FIG. 8.

In other words, in the case of forming an image using plural colors at the same time, the image may be formed without using one of the at least two colors other than yellow (i.e., C and K in the present example). In a specific example, K may be replaced by composite black in order to form an image that appears to be even and to thereby reduce color differences in the formed image.

Figure 9:
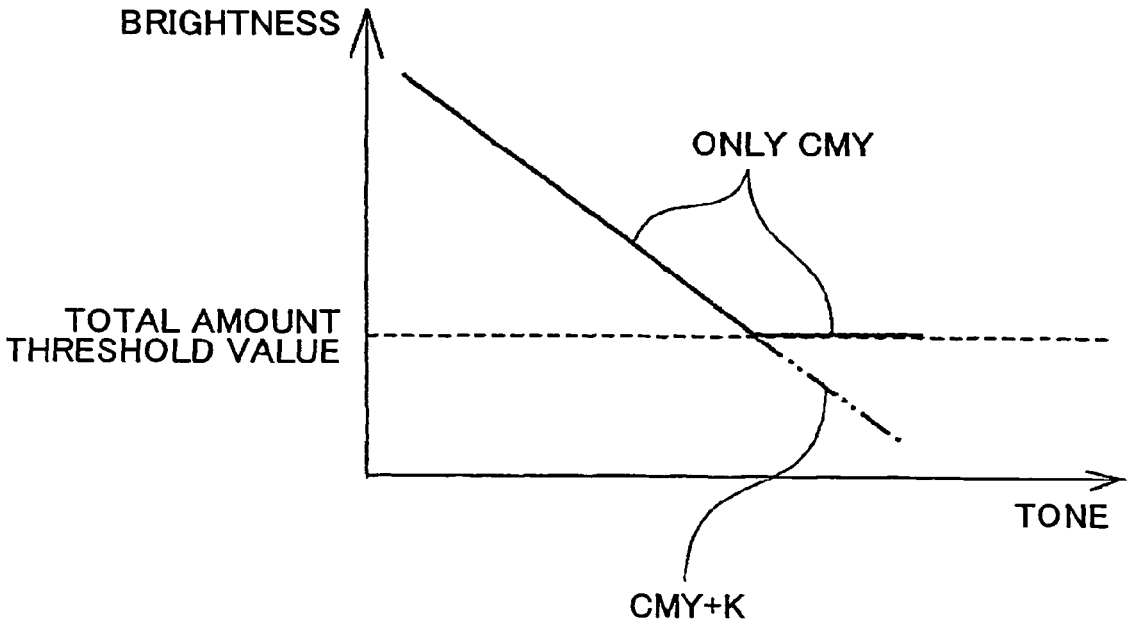
FIG. 9 is a graph illustrating a relationship between the total amount of recording liquid and the image tone in the case where the two or more colors that are each discharged from nozzle arrays of the same liquid discharging head are not used at the same time.

In the case of using composite black made up of colors C, M, and Y that is the equivalent of K in addition to C rather than using the at least two colors other than yellow, namely C and K, the total amount of ink used may reach a total amount threshold value (maximum amount of ink that may be applied while maintaining the image quality) and the color density may be saturated before the maximum tone level is reached as is shown in FIG. 9.

Accordingly, in a preferred embodiment, since color unevenness due to the difference in the color discharging order becomes hardly perceptible when the brightness of an image is below 26, K is used instead of the composite black CMY when the brightness of an image to be formed using plural colors is below 26. In this way, the total amount of ink used may be prevented from exceeding the total amount threshold value. The color density may reach the maximum tone level before the total amount threshold value is reached so that the desired image quality may be maintained and visually perceptible color unevenness may be reduced.

Figure 10:
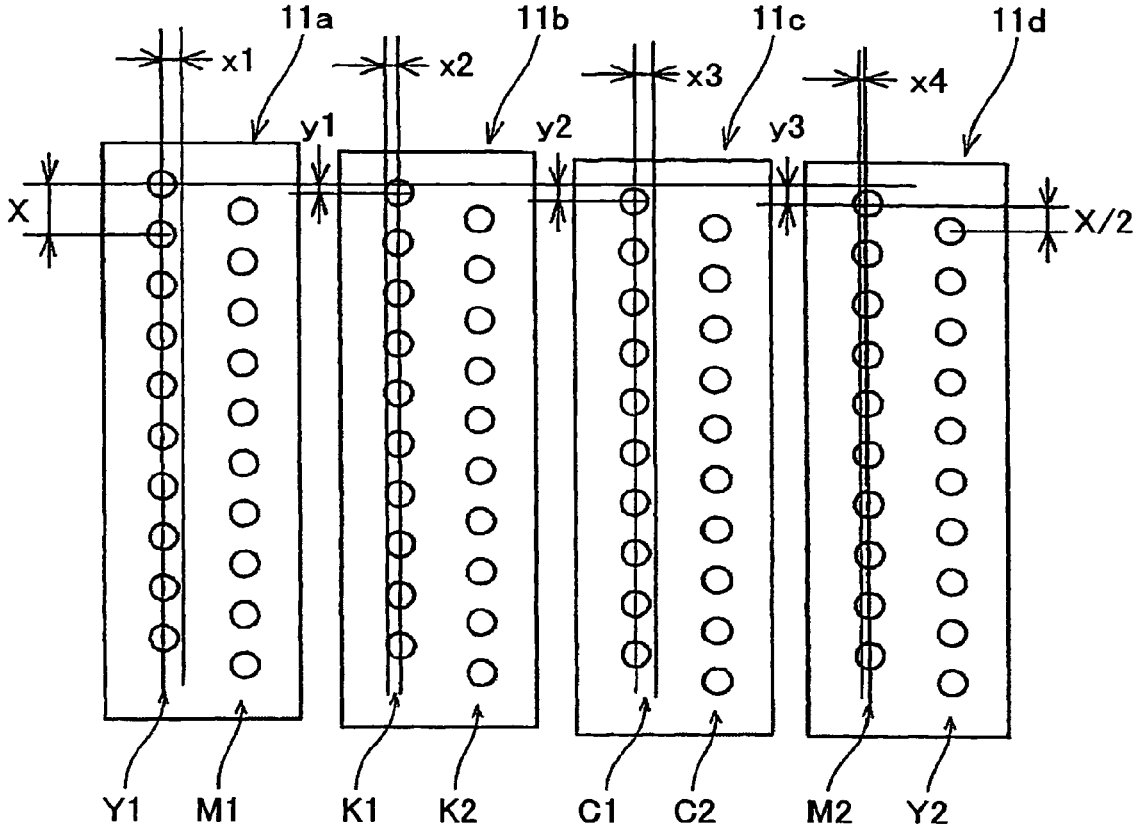
FIG. 10 is a diagram illustrating installation position deviations occurring between liquid discharging heads.
Figure 11:
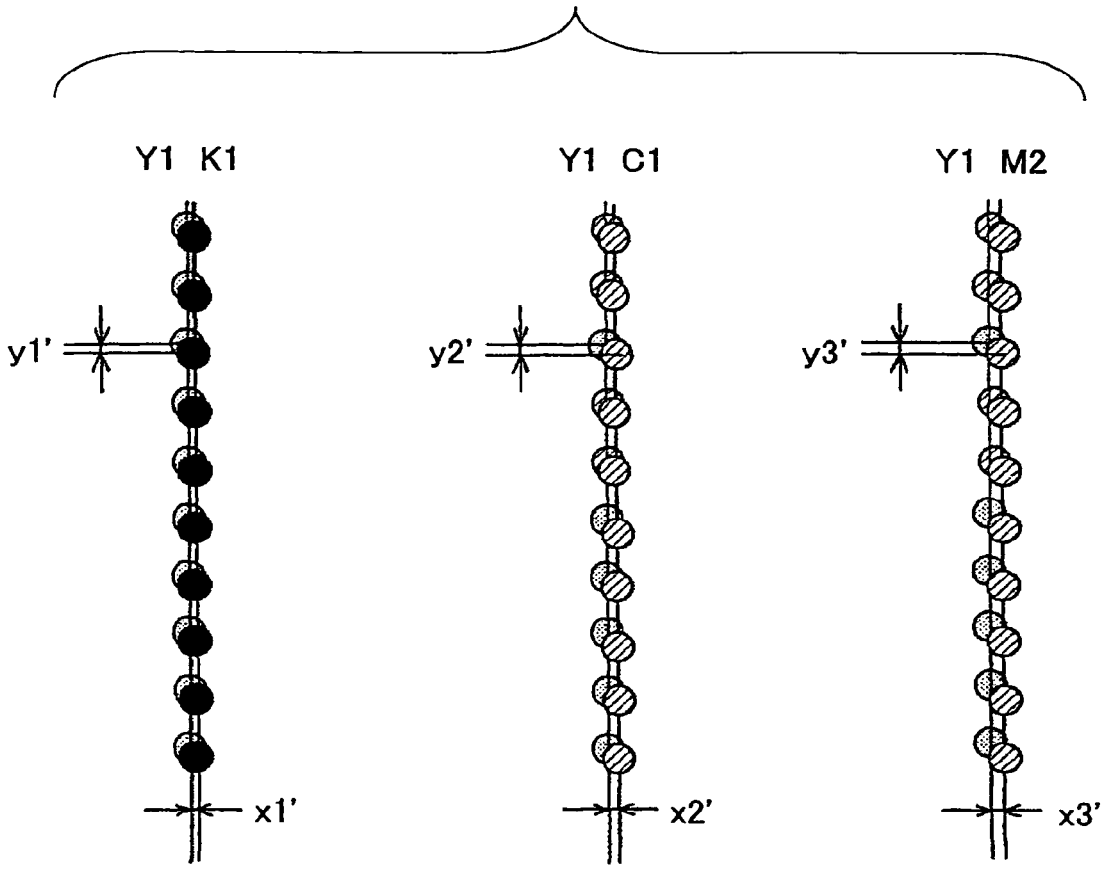
FIG. 11 is a diagram illustrating landing position deviations occurring between recording liquid droplets discharged from nozzle arrays of the liquid discharging heads of FIG. 10.

In the following, landing position deviations between the recording liquid droplets occurring due to positional deviations in the installation of the heads 11*a*-11*d* in the carriage 4 are described with reference to FIGS. 10 and 11. It is noted that FIG. 10 is a diagram illustrating installation position deviations of the heads 11*a*-11*d*, and FIG. 11 is a diagram illustrating the landing position deviations of the recording liquid droplets discharged by the heads 11*a*-11*d*.

It is noted that the landing positions on a recording medium of the recording liquid droplets discharged from the nozzles 11*n* of the heads 11*a*-11*d* are affected by installation position deviations of the heads 11*a*-11*d* installed in the carriage 4. In the illustrated example, a positional deviation of y1 in the sub scanning direction occurs between the heads 11*a* and 11*b*, a positional deviation of y2 in the sub scanning direction occurs between the heads 11*a* and 11*c*, and a positional deviation of y3 in the sub scanning direction occurs between the heads 11*a* and 11*d*. Also, given that that space between the nozzles 11*n* (nozzle pitch) is denoted as X, the nozzle arrays N1 and N2 are shifted with respect to each other by X/2 so that the nozzles 11*n* of the nozzle arrays N1 and N2 may realize a zigzag pattern.

The liquid droplets discharged from the heads 11*a* and 11*b* (droplets of Y1 and K1) are supposed to land in line along the main scanning direction and land at intervals of the nozzle pitch X along the sub scanning direction. However, due to installation deviations of the heads 11*a* and 11*b* with respect to the carriage 4, instability in the carriage operations, and variations in the spraying direction of each of the nozzle arrays, for example, a deviation of x1' in the main scanning direction and a deviation of y1' in the sub scanning direction occur between the landing positions of the droplets Y1 and K1 as is shown in FIG. 11.

Similarly, with regard to the liquid droplets discharged from the heads 11*a* and 11*c* (droplets of Y1 and C1), a deviation of x2' in the main scanning direction and a deviation of y2' in the sub scanning direction occur between the landing positions of these liquid droplets, and with regard to the liquid droplets discharged from the heads 11*a* and 11*d* (droplets of Y1 and M2), a deviation of x3' in the main scanning direction and a deviation of y3' in the sub scanning direction occur between the landing positions of these droplets.

On the other hand, it is noted that landing position deviations hardly occur between liquid droplets discharged from nozzle arrays of the same head.

Accordingly, in the present example, even when installation position deviations occur between the heads 11*a*-11*d* making up the recording head 11, landing position deviations between recording liquid droplets hardly occur in the case of forming an image of a single color of K or C using only head 11*b* or head 11*c*, for example. However, landing position deviations between recording liquid droplets occur in the case of forming an image of a single color of Y or M using heads 11*a* and 11*d* or in the case of using at least two of C, M, Y, and K at the same time.

In the following, referring to FIG. 12, a comparison example is described in which the discharging order of the recording liquids in the different colors is arranged to be the same between outward scanning and homeward scanning.

Figure 12:
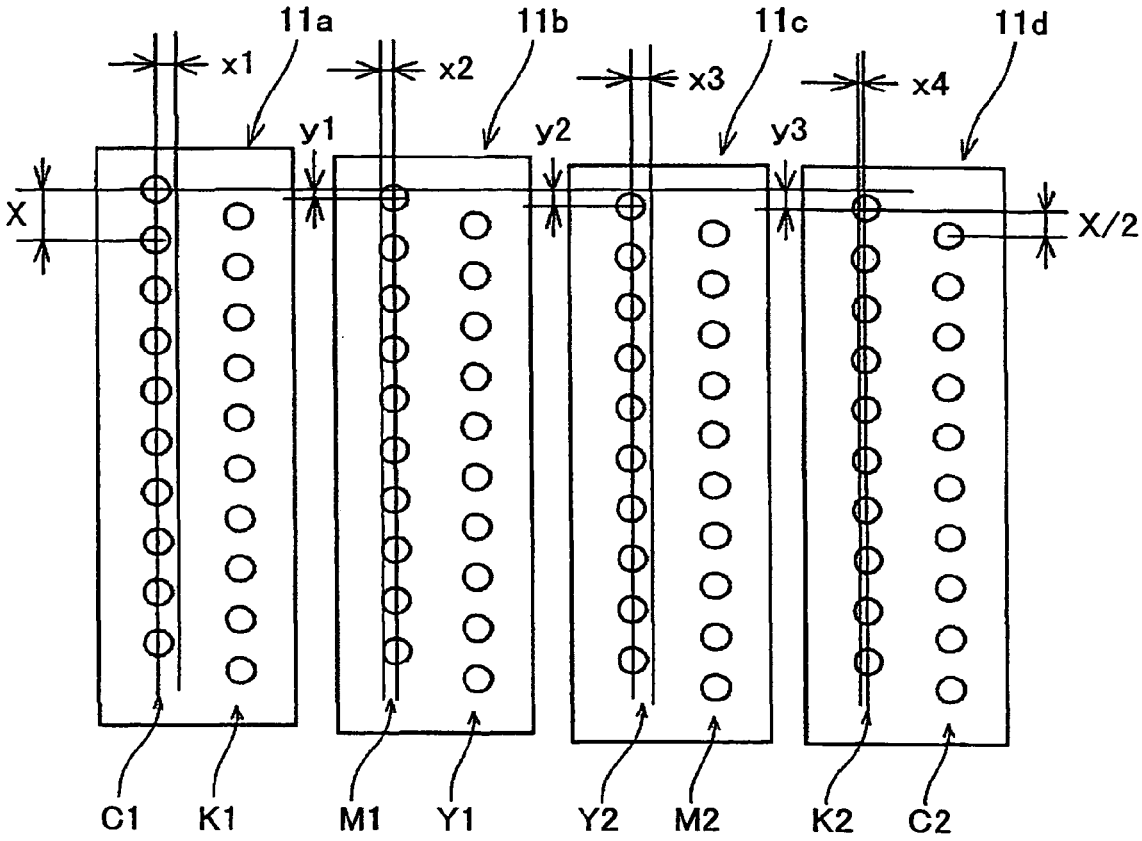
FIG. 12 is a diagram illustrating installation position deviations occurring between liquid discharging heads in a recording head according to a comparison example.

In the comparison example as is illustrated in FIG. 12, the nozzle array N1 of the head 11*a* corresponds to a nozzle array C1 for discharging cyan (C) recording liquid droplets, the nozzle array N2 of the head 11*a* corresponds to a nozzle array K1 for discharging black (K) recording liquid droplets, the nozzle array N1 of the head 11*b* corresponds to a nozzle array M1 for discharging magenta (M) recording liquid droplets, the nozzle array N2 of the head 11*b* corresponds to a nozzle array Y1 for discharging yellow (Y) recording liquid droplets, the nozzle array N1 of the head 11*c* corresponds to a nozzle array Y2 for discharging yellow (Y) recording liquid droplets, the nozzle array N2 of the head 11*c* corresponds to a nozzle array M2 for discharging magenta (M) recording liquid droplets, the nozzle array N1 of the head 11*d* corresponds to a nozzle array K2 for discharging black (K) recording liquid droplets, and the nozzle array N2 of the head 11*d* corresponds to a nozzle array C2 for discharging cyan (C) recording liquid droplets.

It is noted that a deviation of y1 in the sub scanning direction occurs between the heads 11*a* and 11*b*, a deviation of y2 in the sub scanning direction occurs between the heads 11*a* and 11*c*, and a deviation of y3 in the sub scanning direction occurs between the heads 11*a* and 11*d* in the present example as in the previously described example.

Accordingly, a deviation of x1' in the main scanning direction and a deviation of y1' in the sub scanning direction occur between the landing positions of the droplets discharged from the heads 11*a* and 11*b* due to installation deviations of the heads, instability in the carriage operations, and variations in the spraying direction of each of the nozzle arrays, for example. Similarly, a deviation of x2' in the main scanning direction and a deviation of y2' in the sub scanning direction occur between the landing positions of liquid droplets discharged from the heads 11*a* and 11*c*, and a deviation of x3' in the main scanning direction and a deviation of y3' in the sub scanning direction occur between the landing positions of liquid droplets discharged from the heads 11*a* and 11*d*.

Thus, landing position deviations occur between discharged recording liquid droplets in the case of forming an image of a single color of C, M, Y, or K, and also in the case of forming an image using at least two of the colors C, M, Y, and K.

FIG. 13 is a table indicating exemplary determinations of the extent of landing position deviations allowed in view of image quality based on a sensory evaluation in the comparison example with the head configuration and the color arrangement as is described above, the allowable extent being determined by performing a sensory evaluation and a color measurement evaluation on a sample created by adjusting the landing position deviations.

As can be appreciated from the table of FIG. 13, the image qualities of images in black (K) and cyan (C) are more likely to be affected by landing position deviations compared to images in magenta (M), and yellow (Y).

In this respect, according to an embodiment of the present invention, in consideration of the fact that the image qualities of images in the colors black (K) and cyan (C) are more likely to be affected by landing position deviations between the discharged recording liquid droplets realizing these images, the recording liquid droplets in the colors black (K) and cyan (C) are respectively arranged to be discharged from nozzle arrays of the same heads so that landing position deviations between recording liquid droplets in these colors may be controlled so that the image quality based on the sensory evaluation may not be affected and requirements with regard to head position adjustment may be eased. Based on the evaluation results of FIG. 13, in the present embodiment, a desired image quality based on the sensory evaluation may be obtained by arranging the nozzle arrays of the heads such that the extent of the landing position deviations between recording liquid droplets discharged from the nozzle arrays is no more than 30 μm. That is, according to an aspect of the present embodiment, position adjustment of the heads 11*b* and 11*c* may not have to be performed so that the position adjusting mechanism may be simplified and the assembling process time may be reduced to realize cost reduction.

According to another aspect of the present embodiment, a recording liquid supply system for supplying recording liquid to the recording head 11 may be simplified.

Figure 14:
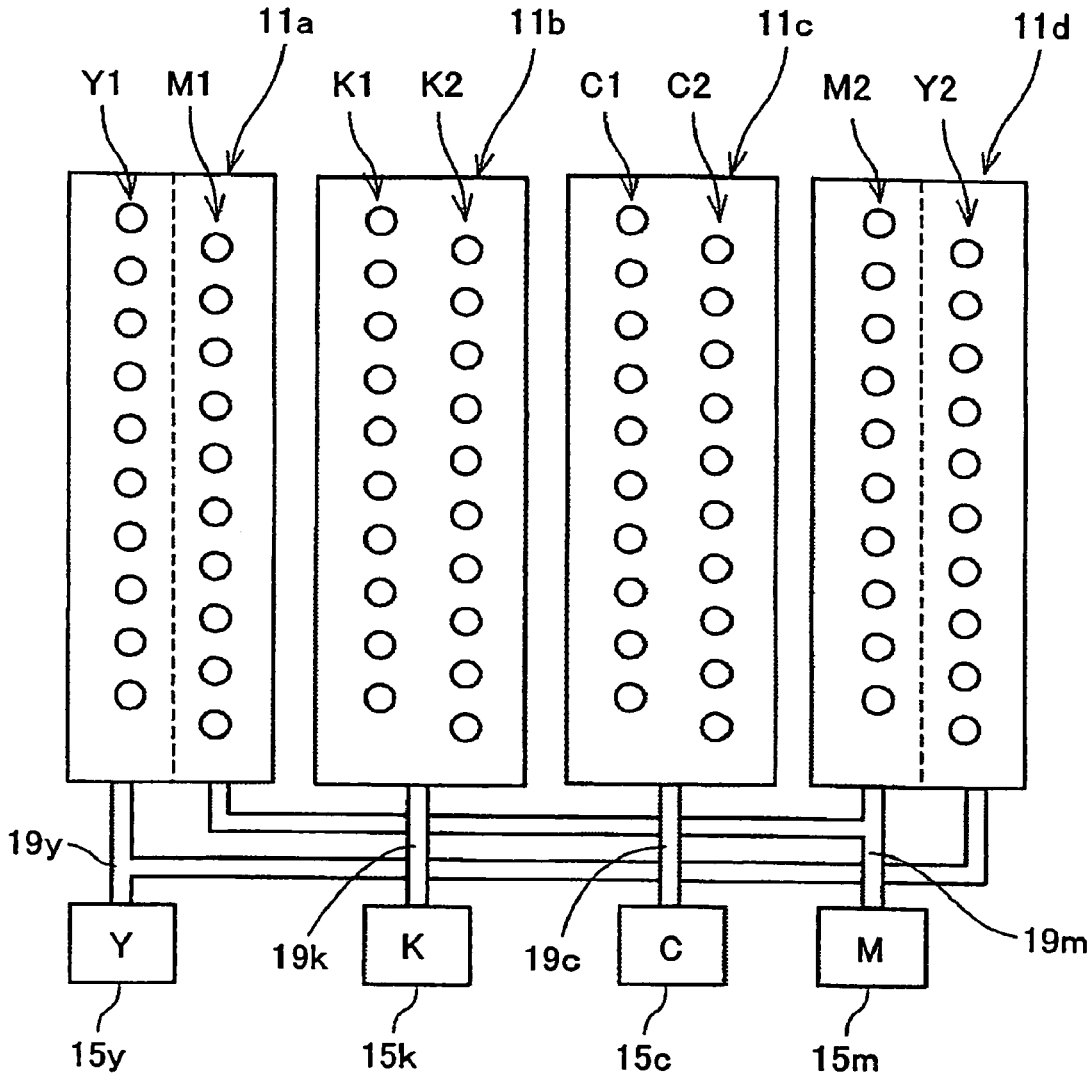
FIG. 14 is a diagram illustrating a recording liquid supply system used in the head configuration of the present embodiment.

Specifically, as is shown in FIG. 14, in the present embodiment, supply paths 19*y* and 19*m* respectively extending from a yellow sub tank 15*y* for supplying yellow (Y) recording liquid to the nozzle arrays Y1 and Y2 and a magenta sub tank 15*m* for supplying magenta (M) recording liquid to the nozzle arrays M1 and M2 each have to be divided into two separate channels to supply their corresponding recording liquids to the different heads 11*a* and 11*d*. However, supply paths 19*k* and 19*c* respectively extending from a black sub tank 15*k* for supplying black (K) recording liquid to the nozzle arrays K1 and K2 that are arranged in the same head and a cyan sub tank 15*c* for supplying cyan (c) recording liquid to the nozzle arrays C1 and C2 that are arranged in the same head each require only one channel. It is noted that in another embodiment, a head that has nozzle arrays for discharging recording liquids in different colors may include plural sub tanks 15 corresponding to the different colors. Thus, in the above example, the heads 11*a* and 11*d* may each have two sub tanks 15.

Figure 15:
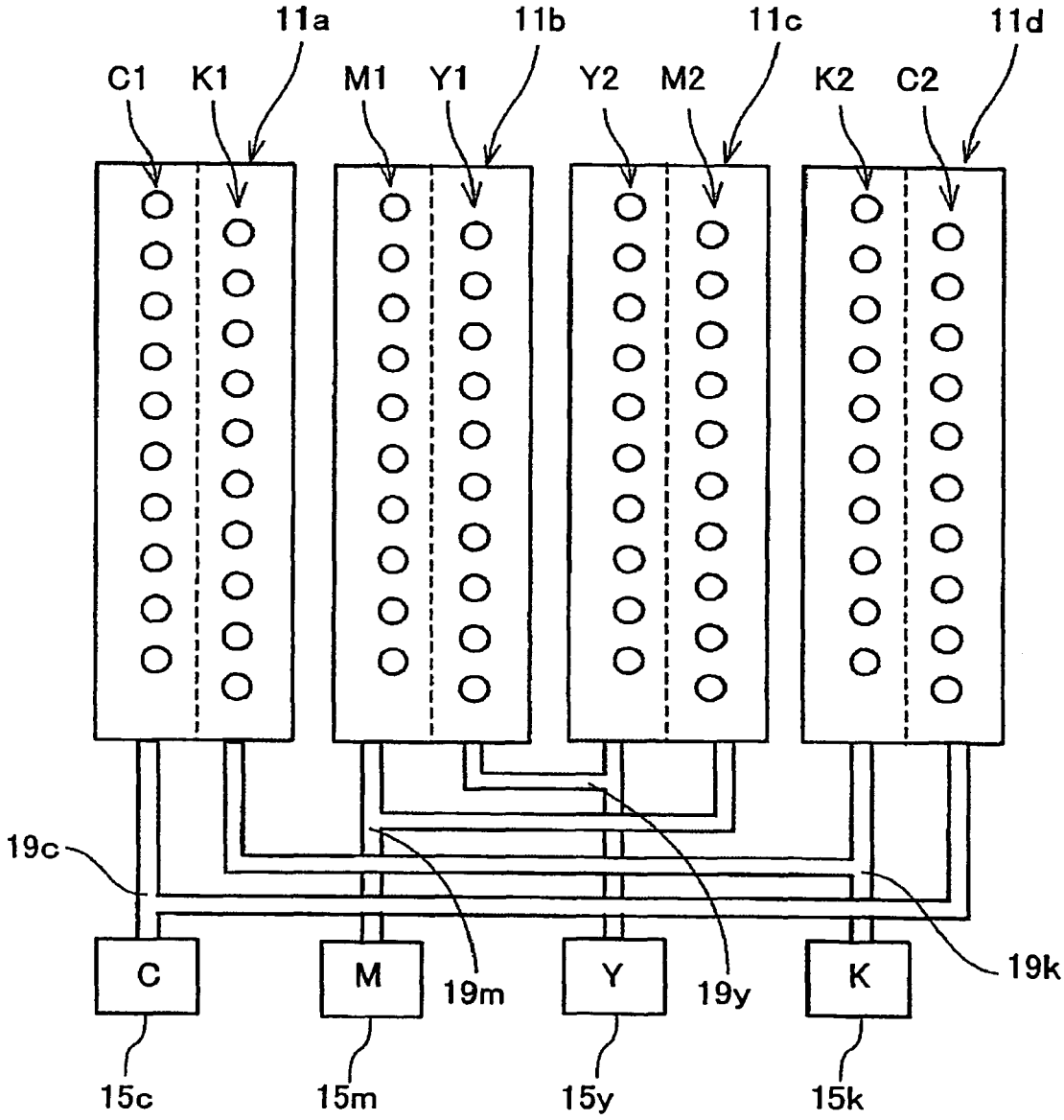
FIG. 15 is a diagram illustrating a recording supply system used in the head configuration of the comparison example.

In the comparison example of FIG. 12, the nozzle arrays of each of the heads 11*a*-11*d* are arranged to discharge recording liquids in different colors, and thereby, each of the supply paths 19 extending from the sub tanks 15 has to be divided into two channels (see FIG. 15), or each of the heads 11*a*-11*d* has to be equipped with two sub tanks 15.

Figure 16:
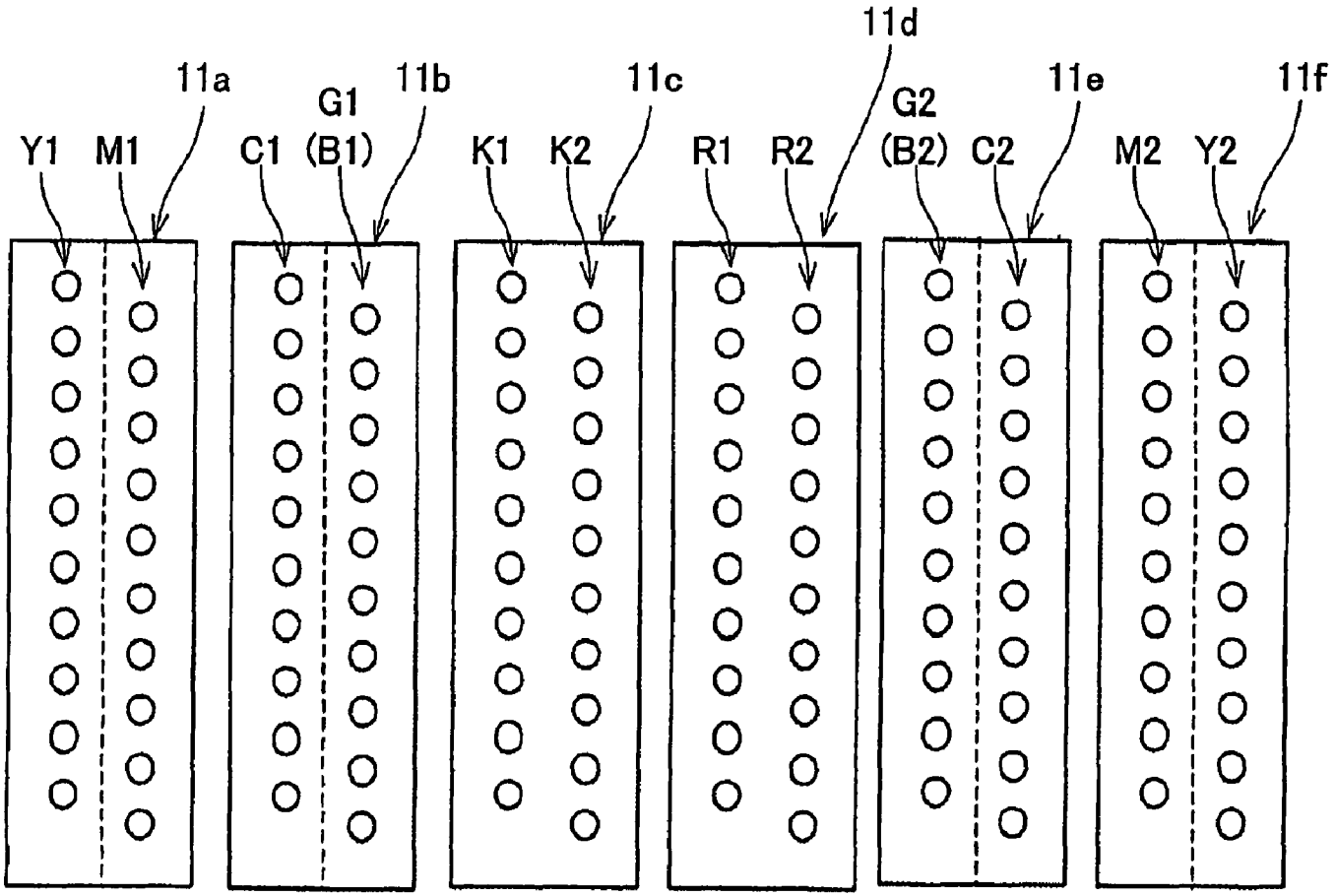
FIG. 16 is a diagram illustrating a head configuration according to another embodiment of the present invention.

In the following, another embodiment of the present invention is described with reference to FIG. 16.

In the present embodiment, recording liquids in six different colors C, M, Y, K, R, and G or C, M, Y, K, R, and B are used rather than using recording liquids in four different colors as in the previously described embodiment.

In the present embodiment, the recording head 11 includes heads 11*a*-11*f*. The head 11*a* includes a nozzle array Y1 for discharging yellow (Y) recording liquid droplets and a nozzle array M1 for discharging magenta (M) recording liquid droplets, the head 11*b* includes a nozzle array C1 for discharging cyan (C) recording liquid droplets and a nozzle array G1 for discharging green (G) recording liquid droplets (or a nozzle B1 for discharging blue (B) recording liquid droplets), the head 11*c* includes nozzle arrays K1 and K2 for discharging black (K) recording liquid droplets, the head 11*d* includes nozzle arrays R1 and R2 for discharging red (R) recording liquid droplets, the head 11*e* includes a nozzle array G2 for discharging green (G) recording liquid droplets (or a nozzle B2 for discharging blue (B) recording liquid droplets) and a nozzle array C2 for discharging cyan (C) recording liquid droplets, and the head 11*f* includes a nozzle array M2 for discharging magenta (M) recording liquid droplets and a nozzle array Y2 for discharging yellow (Y) recording liquid droplets.

FIG. 17 is a table indicating exemplary determinations of the extent of landing position deviations allowed in view of a desired image quality based on a sensory evaluation in the present embodiment with the head configuration and the color arrangement as is described above, the allowable extent being determined by performing a sensory evaluation and a color measurement evaluation on a sample created by adjusting the landing position deviations.

As can be appreciated from the table of FIG. 17, the image qualities of images in black (K) and red (R) are more likely to be affected by landing position deviations between the recording liquid droplets realizing these images compared to the other colors. Accordingly, nozzle arrays arranged in the same head are used to discharge liquid droplets in the colors black (K) and red (R) so that image degradation due to landing position deviations between discharged recording liquid droplets in these colors may be prevented and the image quality may be improved.

Although the present invention is shown and described with respect to certain preferred embodiments, it is obvious that equivalents and modifications will occur to others skilled in the art upon reading and understanding the specification. The present invention includes all such equivalents and modifications, and is limited only by the scope of the claims.

For example, in the above descriptions, recording heads with a four-color configuration and a six-color configuration are described. However, the present invention is not limited to such embodiments, and a recording head according to another embodiment of the present invention may be arranged to discharge recording liquids in seven or more colors, for example.

Also, it is noted that although an imaging apparatus having a printer configuration is described above, the present invention may equally be applied to other types of imaging apparatuses such as a multifunction imaging apparatus having printer, fax, and copier functions. Also, it is noted that the present invention may be applied to imaging apparatuses using a liquid other than ink as the recording liquid, for example.

The present application is based on and claims the benefit of the earlier filing date of Japanese Patent Application No. 2005-144016 filed on May 17, 2005, the entire contents of which are hereby incorporated by reference.

The invention claimed is:

1. An imaging apparatus comprising:

four heads which are arranged in a main scanning direction, the heads including eight nozzle arrays arranged in the main scanning direction and configured to discharge droplets of recording liquids;

wherein the colors of the recording liquids are yellow, magenta, cyan and black, respectively, one nozzle array of the eight nozzle arrays is configured to discharge yellow recording liquid, another nozzle array of the eight nozzle arrays is configured to discharge magenta recording liquid, said one nozzle array configured to discharge yellow recording liquid and said another nozzle array configured to discharge magenta recording liquid are arranged in a same head of the four heads and are shifted with respect to each other by a distance of ½ pitch, and two of the nozzle arrays are configured to discharge cyan recording liquid and black recording liquid, respectively.

2. The imaging apparatus as claimed in claim 1, wherein the heads use an electrothermal transducing element configured to generate pressure for discharging the recording liquids.

3. The imaging apparatus as claimed in claim 1, wherein the heads use an electromechanical transducing element configured to generate pressure for discharging the recording liquids.

4. The imaging apparatus as claimed in claim 1, wherein said one nozzle array configured to discharge yellow recording liquid and said another nozzle array configured to discharge magenta recording liquid are arranged in the same one of the heads, and an additional nozzle array of the eight nozzle arrays is configured to discharge yellow recording liquid, an additional nozzle array of the eight nozzle arrays is configured to discharge magenta recording liquid, and the additional nozzle array configured to discharge yellow recording liquid and the additional nozzle array configured to discharge magenta recording liquid are arranged in a second one of the heads.

5. The imaging apparatus as claimed in claim 1, wherein an additional nozzle array of the eight nozzle arrays is configured to discharge yellow recording liquid, and said one nozzle array configured to discharge yellow recording liquid and the additional nozzle array configured to discharge yellow recording liquid are shifted with respect to each other by ½ pitch.

6. The imaging apparatus as claimed in claim 1, wherein an additional nozzle array of the eight nozzle arrays is configured to discharge yellow recording liquid, and the additional nozzle array configured to discharge yellow recording liquid and said another nozzle array configured to discharge magenta recording liquid are arranged in respective different heads.

7. The imaging apparatus as claimed in claim 1, wherein an additional nozzle array of the eight nozzle arrays is configured to discharge magenta recording liquid, and said another nozzle array configured to discharge magenta and the additional nozzle array configured to discharge magenta recording liquid are shifted with respect to each other by ½ pitch.

8. The imaging apparatus as claimed in claim 1, wherein an additional nozzle array of the eight nozzle arrays is configured to discharge magenta recording liquid, and the additional nozzle array configured to discharge magenta recording liquid and said one nozzle array configured to discharge yellow recording liquid are arranged in respective different heads.

9. The imaging apparatus as claimed in claim 1, wherein said one nozzle array configured to discharge yellow recording liquid and said another nozzle array configured to discharge magenta recording liquid are arranged in the same one of the heads, an additional nozzle array of the eight nozzle arrays is configured to discharge black recording liquid, an additional nozzle array of the eight nozzle arrays is configured to discharge cyan recording liquid, and the additional nozzle array configured to discharge black recording liquid and the additional nozzle array configured to discharge cyan recording liquid are arranged in a second one of the heads.

10. The imaging apparatus as claimed in claim 1, wherein said one nozzle array configured to discharge yellow recording liquid and said another nozzle array configured to discharge magenta recording liquid are arranged in the same one of the heads, and each of two nozzle arrays of the eight nozzle arrays is configured to discharge black recording liquid, each of two nozzle arrays of the eight nozzle arrays is configured to discharge cyan recording liquid, the two nozzle arrays configured to discharge black recording liquid are arranged in a second one of the heads, and the two nozzle arrays configured to discharge cyan recording liquid are arranged in a third one of the heads.

11. The imaging apparatus as claimed in claim 1, wherein each head of the four heads includes a corresponding pair of the eight nozzle arrays, and each pair of nozzle arrays arranged in the same head are shifted with respect to each other by ½ pitch.

12. The imaging apparatus as claimed in claim 1, wherein two nozzle arrays of the eight nozzle arrays are configured to discharge yellow recording liquids, two nozzle arrays of the eight nozzle arrays are configured to discharge magenta recording liquids, two nozzle arrays of the eight nozzle arrays are configured to discharge black recording liquids, two nozzle arrays of the eight nozzle arrays are configured to discharge cyan recording liquids, and each pair of two nozzle arrays configured to discharge respective recording liquids of the same color are shifted with respect to each other by ½ pitch.

13. An imaging apparatus comprising:

four heads which are arranged in a main scanning direction, the heads including eight nozzle arrays arranged in the main scanning direction and configured to discharge droplets of recording liquids;

wherein the colors of the recording liquids are yellow, magenta, cyan and black, respectively, two of the nozzle arrays are configured in the same head, two of the nozzle arrays are configured to discharge the cyan and black recording liquids, are vulnerable to position deviation, and are arranged in the same heads, two of the nozzle arrays are configured to discharge the yellow and magenta recording liquids and are separately arranged in different heads, the nozzle arrays that discharge liquid droplets of the same color are shifted with respect to each other by a distance of ½ pitch, and the nozzle arrays arranged in the same head are shifted with respect to each other by ½ pitch, and wherein an extent of landing position deviation between recording liquid droplets discharged from the nozzle arrays is arranged to be no more than 30 μm.

14. An imaging apparatus comprising:

four heads which are arranged in a main scanning direction, the heads including eight nozzle arrays arranged in the main scanning direction and configured to discharge droplets of recording liquids;

wherein the colors of the recording liquids are yellow, magenta, cyan and black, respectively, two of the nozzle arrays are configured in the same head, two of the nozzle arrays are configured to discharge the cyan and black recording liquids, are vulnerable to position deviation, and are arranged in the same heads, two of the nozzle arrays are configured to discharge the yellow and magenta recording liquids and are separately arranged in different heads, the nozzle arrays that discharge liquid droplets of the same color are shifted with respect to each other by a distance of ½ pitch, and the nozzle arrays arranged in the same head are shifted with respect to each other by ½ pitch, and wherein when an image to be formed corresponds to an image that is normally realized by using a first recording liquid and a second recording liquid simultaneously, at least one of the first recording liquid and the second recording liquid is refrained from being used.

15. The imaging apparatus as claimed in claim 14, wherein the first recording liquid and the second recording liquid are used simultaneously when the image to be formed has a brightness below 26.

16. An imaging apparatus comprising a plurality of heads arranged in a main scanning direction, the heads including a plurality of nozzle arrays arranged in a nozzle arrangement direction to discharge droplets of recording liquids, wherein the heads are disposed to discharge droplets of at least four colors, and said at least four colors of the discharged droplets include yellow, wherein a nozzle array that discharges droplets of yellow recording liquid is arranged along with a nozzle array that discharges droplets of one color other than yellow, in a separate head, wherein for each specific color of two colors other than yellow and other than said one color other than yellow, each of two nozzle arrays arranged in one the heads discharges droplets of the specific color, and wherein the nozzle array that discharges the droplets of yellow recording liquid and the nozzle array that discharges the droplets of said one color other than yellow are shifted relative to each other in the nozzle arrangement direction and do not overlap in the main scanning direction.

17. The imaging apparatus as claimed in claim 16, wherein the head including the nozzle array that discharges the droplets of yellow recording liquid and the nozzle array that discharges the droplets of said one color other than yellow is offset in the main scanning direction relative to the heads including the nozzle arrays that discharge droplets of the two colors other than yellow.

* * * * *